United States Patent [19]

Corder

[11] 4,291,462

[45] Sep. 29, 1981

[54] SHEARING DEVICE

[75] Inventor: E. E. Corder, Lakewood, Colo.

[73] Assignee: A.S.M., Inc., Denver, Colo.

[21] Appl. No.: 140,172

[22] Filed: Apr. 14, 1980

[51] Int. Cl.[3] ..... B26B 19/00

[52] U.S. Cl. ..... 30/221

[58] Field of Search ..... 30/221, 222, 216, 220

[56] References Cited

U.S. PATENT DOCUMENTS

| | | | |
|---|---|---|---|
| 5,166 | 11/1872 | Van Doren | 30/208 |
| 155,855 | 10/1874 | Burgess . | |
| 542,380 | 7/1895 | Silver | 30/221 |
| 547,718 | 10/1895 | Fletcher et al. | 30/210 |
| 576,902 | 2/1897 | Scouler | 30/222 X |
| 814,113 | 3/1906 | Burley . | |
| 926,727 | 7/1909 | Cahill . | |
| 1,227,572 | 5/1917 | Bodene . | |
| 1,567,110 | 12/1925 | Bristow . | |
| 1,644,141 | 10/1927 | McArdle . | |
| 1,646,470 | 10/1927 | Wright et al. . | |
| 1,692,870 | 11/1928 | Scott | 30/222 |
| 1,723,323 | 8/1929 | Bartlett . | |
| 2,080,451 | 5/1937 | Wilcox . | |
| 2,081,318 | 5/1937 | Wright . | |
| 2,232,361 | 2/1941 | Bartlett . | |
| 3,467,204 | 9/1969 | Jenkinson | 173/169 |
| 4,094,065 | 6/1978 | Geary | 30/210 |

FOREIGN PATENT DOCUMENTS

| | | | |
|---|---|---|---|
| 16029 | of 1890 | United Kingdom | 30/221 |

*Primary Examiner*—Jimmy C. Peters
*Attorney, Agent, or Firm*—W. Scott Carson

[57] ABSTRACT

A shearing device for shearing sheep. The shears include a hollow handpiece, comb, fork, cutter, and tensioning arm. The comb has a planar face and is rigidly attached to the front of the handpiece. The fork is pivotally mounted within the handpiece with the cutter attached to one of its ends and supported in sliding engagement with the comb's planar face. An arrangement for adjusting the pressure with which the cutter engages the comb includes the tensioning arm which is pivotally mounted with a first end portion abutting the fork and a second end portion extending along a fixed, pivotal axis that is colinear with the pivotal axis of the fork. The adjusting device applies a force to the second end portion of the tensioning arm symmetrically about and axially along the fixed, pivotal axis and the tensioning arm serves to transfer this force to the fork symmetrically about and axially along another axis that is perpendicular to the planar face of the comb. The arrangement of the tensioning arm and fork and the manner in which the force of the adjusting device is transferred to the fork and cutter results in a cool and even running shearing device in which the cutter applies an even pressure to the comb along its entire path of travel across the comb. Several safety features are also present including a square gripping handle for better control and alignment and an arrangement whereby the tensioning arm cannot be separated from the fork during normal operation of the shears.

7 Claims, 5 Drawing Figures

SHEARING DEVICE

FIELD OF THE INVENTION

This invention relates to the field of shears and more particularly to the field of sheep shears.

BACKGROUND OF THE INVENTION AND PRIOR ART

Sheep shearing is a demanding occupation that depends as much upon the skill of the individual shearer as it does on the tools he uses to be successful. Like the skills of the individual shearers, the designs of shearing devices vary widely; however, the commercially available shearing devices sold by most manufacturers and used by the vast majority of shearers tend to have a common design that dates back to the turn of the century. In this common design, an elongated fork member is mounted within a hollow handpiece for pivotal movement about an axis. The handpiece has a comb member rigidly mounted to its front and the elongated fork has a cutter member attached to one of its ends. On a portion of the comb, there is a planar face and the cutter is supported to slidingly engage it. In operation, the fork is pivotally moved about its axis which, in turn, reciprocally moves the cutter along an arcuate path across the planar face of the comb. To adjust the pressure with which the cutter bears against the comb, an arrangement is provided that includes a pin or similar member which abuts the fork at a location between the fork's pivotal axis and the cutter which is attached to one of the ends of the fork.

Typical examples of this basic design are illustrated in U.S. Pat. No. 3,467,204 to Jenkinson (see his FIG. 1) and U.S. Pat. No. 4,094,065 to Geary (see his FIG. 1). Variations in this common design are illustrated in U.S. Pat. Nos. 814,113 to Burley, 1,723,323 to Bartlett, 2,080,451 to Wilcox, 2,081,318 to Wright, and 2,232,361 to Bartlett; however, all of these shearing designs have an inherent design defect. Specifically, the arrangements for adjusting the pressure with which the cutter bears against the comb include members which provide a forward thrust. That is, the adjustable force applied to the fork and cutter is not applied symmetrically about an axis that is perpendicular to the planar face of the comb. Rather, it is applied at an angle to this plane as best seen in FIG. 1 of the patents to Jenkinson and Geary. As explained by Burley in his lines 17–19 of his column 1, this forward thrust is provided in order to permit the wear of the cutter to be taken up. Unfortunately, there are several inherent drawbacks in using this forward thrust. First, it applies a force to the pivot bearing of the fork in a direction which is not aligned with the pivotal axis of the fork. This causes irregular wear in the bearing and eventually leads to excessive play in the movement of the fork. Second, and perhaps of more significance, adjustments in the amount of forward thrust provided by the pin member are achieved by physically moving the pin member forward or rearward with the result that the pivotal axis of the pin member shifts and is different for each force setting. Because of this shifting of the pivotal axis of the pin member, the pivotal axis of the fork (which is fixed) and the pivotal axis of the pin member are, at best, only colinear at one force setting. Consequently, at all but this one force setting, the radius of curvature of the fork's movement in a plane parallel to the planar face of the comb has a different center than that of the pin member in this same plane. The result is a non-uniform application of force to the cutter as it reciprocally moves along its arcuate path across the planar face of the comb.

In most of these prior art shears, the pivotal axis of the pin member is forward of the pivotal axis of the fork so that the cutter bears against the comb with more pressure in the middle of its arcuate path across the comb than at the ends. In practice, the shearer compensates for this non-uniform application of pressure by adjusting the pin member to be tight enough to apply the desired pressure at the ends of the cutter's arcuate path so that it will cut along the full length of the path; but, the effect of this is that too much pressure is applied in the middle of the path and the planar face of the comb is literally eaten away in this area. Unless the planar face of the comb is again ground flat, the fork and cutter begin to rock about the longitudinal axis of the fork reducing the cutting efficiency of the shearing device and significantly reducing the quality of the cut. Further, this rocking creates excessive vibrations in the shearing device adding to the strain put on the shearer and greatly reducing his efficiency and control of the shears. Also, the need for frequent grinding of the comb's planar face significantly reduces the comb's life and greatly increases the cost of operating the shears.

With the shears of the present invention, these problems are overcome because the tensioning arm or pin member of the present invention always has the same pivotal axis and the axis is colinear with the pivotal axis of the fork. Further, the force applied to the tensioning arm is applied symmetrically about and axially along this common pivotal axis with no forward thrust created at all; and, the force applied by the tensioning arm to the fork and cutter is applied symmetrically about and axially along an axis which is perpendicular to the planar face of the comb member. Since there is no forward thrust component in these forces and since the pivotal axis of the tensioning arm is fixed and colinear with the axis of the fork, the cutter of the present shears applies an even pressure to the comb along its entire path of travel across it resulting in a cool and smooth running shearing device which provides superior performance and requires less maintenance, particularly to the pivot bearing of the fork and the planar face of the comb.

Examples of other shearing devices in the general area are U.S. Pat. Nos. 5,166 to VanDoren, 155,855 to Burgess, 547,718 to Fletcher, 926,727 to Cahill (which discloses no means at all to adjust the pressure between the cutter and comb other than by raising or lowering shaft 9 to move the pivotal axis of the fork; but, this is totally ineffective because this will merely rock the back, driven end of the fork up and down and off-set the cutter on the comb), U.S. Pat. Nos. 1,227,572 to Bodene, 1,567,110 to Bristow, 1,644,141 to McArdle, and 1,646,470 to Wright.

SUMMARY OF THE INVENTION

This invention involves a shearing device primarily intended for shearing sheep. The shears include a hollow handpiece within which is pivotally mounted an elongated fork. The fork is driven at one end by a conventional arrangement which translates rotary motion from a power source into pivotal movement of the fork. A cutter is mounted to the other end of the fork and the pivotal movement of the fork serves to reciprocally move the cutter along an arcuate path across the planar face of a comb which is rigidly mounted to the front of the handpiece. A tensioning arm is also mounted within the handpiece for pivotal movement about a fixed axis that is colinear with the pivotal axis of the fork. The tensioning arm has first and second end portions and is mounted with the first end portion abutting the fork at a location between the pivotal axis of the fork and the cutter attached thereto and with the second end portion extending along the fixed, pivotal axis.

In operation, the pressure with which the cutter engages the comb is adjusted by moving the second end portion of the tensioning arm along the fixed, pivotal axis which in turn adjusts the force with which the first end portion of the tensioning arm abuts the fork. The pivotal axis of the tensioning arm always remains the same and is colinear with the pivotal axis of the fork so that an even pressure is always applied between the cutter and the comb along the entire reciproval travel path of the cutter across the comb. Further, the force applied to the second end portion of the tensioning arm by the adjusting means is always applied symmetrically about and axially along the pivotal axis of the fork so as to promote even wearing of the pivot bearing of the fork. Similarly, the force applied by the tensioning arm at its first end portion to the fork is always applied symmetrically about and axially along an axis that is perpendicular to the planar face of the comb. In this manner, a shearing device is provided which evenly applies pressure at all points along the travel path of the cutter across the comb resulting in a smooth and cool running device which is less fatiguing to operate and requires less operating maintenance than currently available shears.

The shears of the present invention also include several safety features such as a gripping handle with a substantially square cross section for better control and alignment of the shears and an arrangement whereby the tensioning arm cannot be separated from the fork without disassembling the shears. In this manner, should the shears jam, the cutter or comb will be broken rather than the arm becoming disengaged. Consequently, the handpiece will not jerk or violently twist in the operator's hand as commonly occurs in currently available shears causing severe sprains to the operator and often complete loss of control of the shears by the operator.

DETAILED DESCRIPTION OF THE PREFERRED EMBODIMENT

Figure 1:
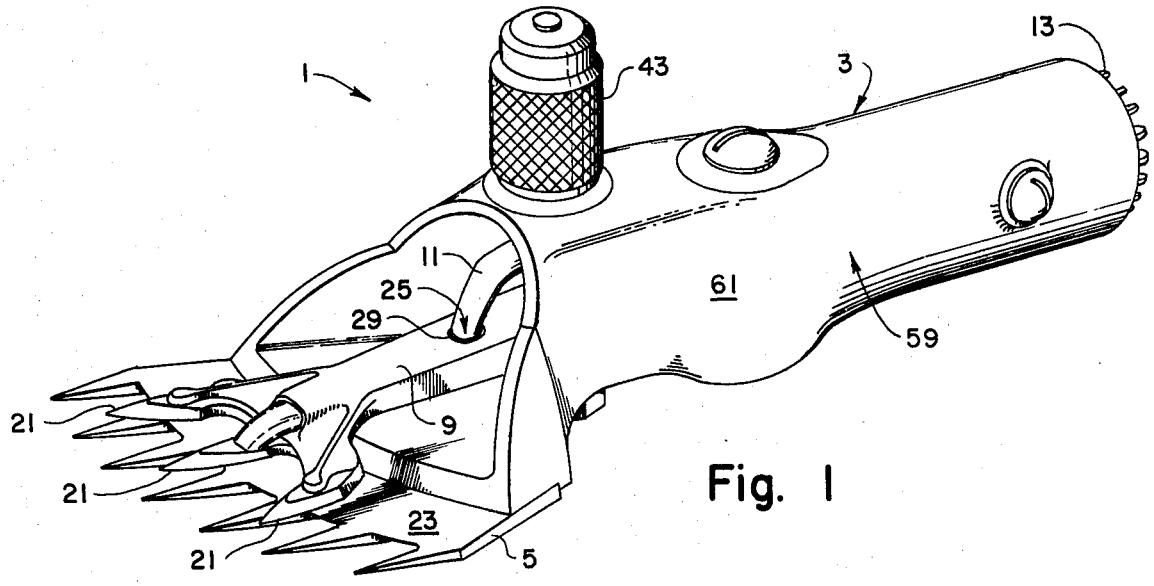
FIG. 1 is a perspective view of the shearing device of the present invention illustrating the relative positioning of the various parts thereof.
Figure 2:
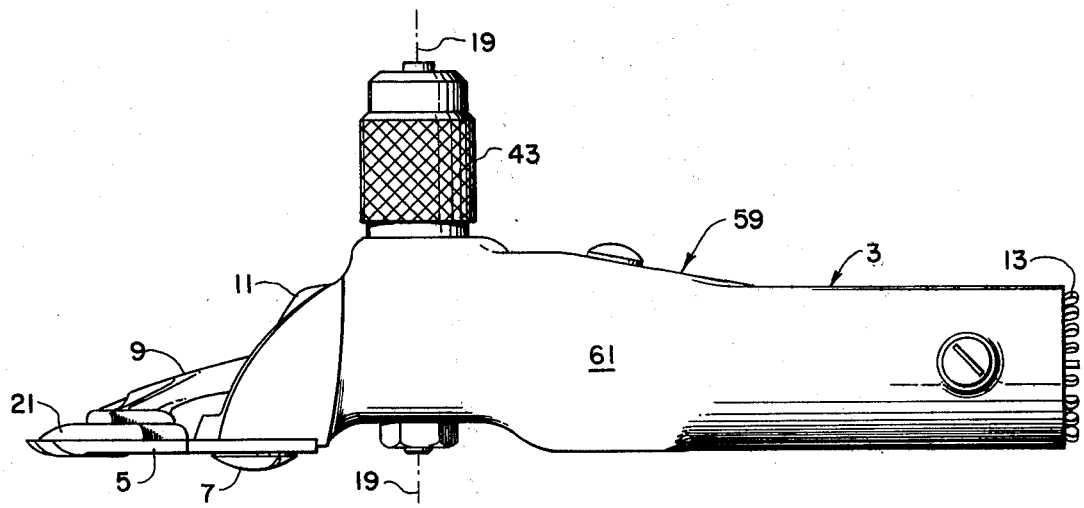
FIG. 2 is a side view of the shearing device of the present invention.
Figure 3:
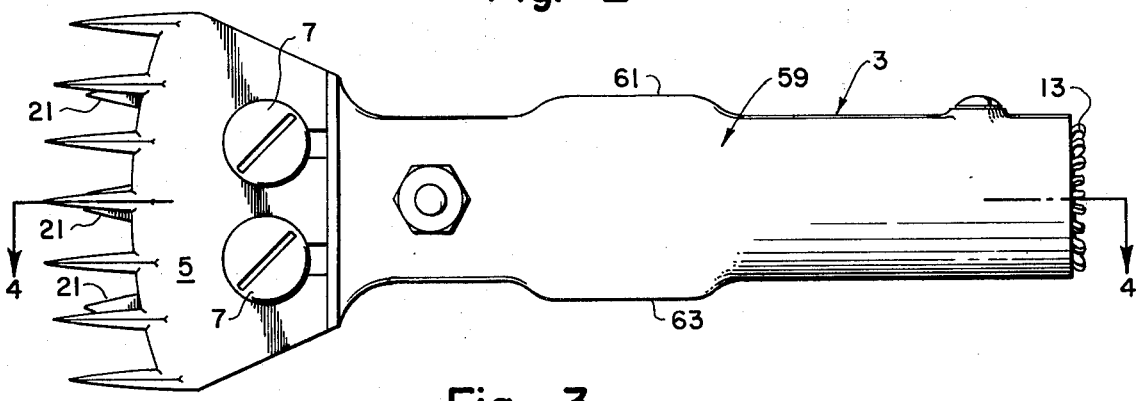
FIG. 3 is a bottom view of the shearing device illustrating the manner in which the comb is mounted to the front of the handpiece.

Referring to FIGS. 1–5, the shearing device 1 of the present invention includes a hollow handpiece 3 to which is rigidly mounted a comb member 5 by screws 7. Within the hollow handpiece 3 is mounted an elongated arm or fork member 9, tensioning arm 11, and a conventional driving arrangement (see FIG. 4) of gear 13, shaft 15, and eccentrically mounted bearing 17 whereby rotary motion of the gear 13 is translated to reciprocating, pivotal movement of the elongated arm or fork member 9 about the axis 19 (see FIGS. 2 and 4). Cutter member 21 is mounted to one end of the fork 9 and slidingly engages the planar face 23 of the comb member 5 whereby the pivotal movement of the fork 9 about its axis 19 reciprocally moves the cutter member 21 along an arcuate path across the planar face 23 of the comb member 5.

Figure 4:
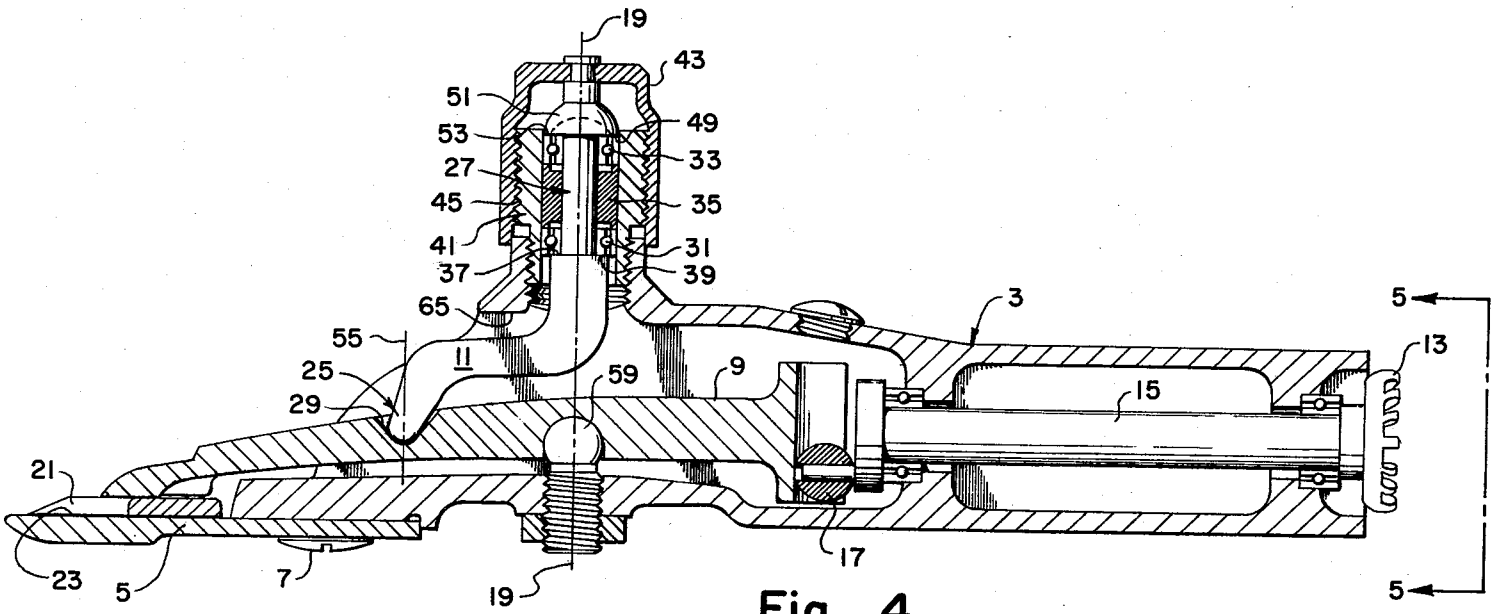
FIG. 4 is a cross-sectional view of the shearing device taken along line 4—4 of FIG. 3 illustrating the working relationships between the various parts thereof.
Figure 5:
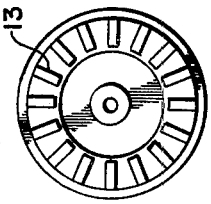
FIG. 5 is a rear view taken along line 5—5 of FIG. 4 illustrating the gear 13 which is part of the conventional arrangement whereby rotary movement from a power source is translated into reciprocating, pivotal movement of the fork.

As best seen in FIG. 4, the tensioning arm 11 has first and second end portions 25 and 27. The first end portion 25 fits into a slot 29 in the fork 9 at a location substantially midway between the fork's pivotal axis 19 and the cutter member 21. The second end portion 27 of the tensioning arm 11 extends along the axis 19. The tensioning arm 11 is mounted for pivotal movement by annular bearings 31 and 33 which are separated from each other by the spacer 35. The lower bearing 31 abuts against the surface 37 of the annular ledge 39 on the tensioning arm 11. The second end portion 27 of the tensioning arm 11 together with the annular bearings 31 and 33 and spacer 35 are mounted within the cylindrical member 41 which always maintains and limits the pivotal movement of the tensioning arm 11 to about a common axis which is colinear with the pivotal axis 19 of the fork 9.

In operation, the pressure with which the cutter member 21 engages the planar face 23 of the comb member 5 is adjusted by screwing the adjusting cap 43 up or down on the threads 45 of the outer surface of the cylindrical member 41. To increase the pressure, the adjusting cap 43 is screwed so that the annular surface 49 of the member 51 inside the adjusting cap 43 abuts a mating annular surface 53 on the bearing 33 to move the bearing 33, spacer 35, bearing 31, and tensioning arm 11 downwardly in FIG. 4. This movement in turn moves the first end portion 25 of the tensioning arm 11 abutting the fork 9 within the slot 29 downwardly along an axis 55 perpendicular to the planar face 23 of the comb member 5. The force applied by the annular surface 49 to the mating annular surface 53 of the bearing 33 and through the bearing 33, spacer 35, and bearing 31 to the tensioning arm 11 is applied symmetrically about and axially along the pivotal axis of the tensioning arm 11 which is colinear with the pivotal axis 19 of the fork 9 and also perpendicular to the planar face 23 of the comb member 5. In this manner, pressure is evenly applied to the pivotal bearing 59 of the fork 9 to promote even wearing thereof. Further, the force applied to the fork 9 by the first end portion 25 of the tensioning arm 11 is applied symmetrically about and axially along an axis 55 that is perpendicular to the planar face 23 of the comb member 5. The cylindrical member 41 positively limits the pivotal movement of the tensioning arm 11 (regardless of whether the tensioning arm 11 is in a first position in which the first end portion 25 is close to the planar face 23 or in a second position in which the first end portion 25 is spaced farther therefrom) to about a common axis which is colinear with the pivotal axis 19 of the fork 9. In this manner, the center of the fork's 9 radius of curvature in a plane parallel to the planar face 23 of the comb member 5 is always the same as the center of the radius of curvature of the tensioning arm 11 in the same plane. Consequently, the cutter 21 of the shearing device 1 applies an even pressure to the comb member 5 along its entire arcuate path across the planar face 23 of the comb member 5. This results in a cool and smooth running shearing device 1 that is less fatiguing to the operator, superior in performance, and needing fewer repairs, particularly to the pivot bearing 59 of the fork 9 and planar face 23 of the comb member 5. Also, since the cutter 21 applies an even pressure to the planar surface 23 of the comb member 5 along its entire arcuate path, it is possible to make the arcuate stroke of the cutter 21 longer so that a wider arc could be cut than is possible with current shears.

The shearing device 1 of the present invention also includes several safety features. In particular, it has a gripping handle 59 which has a substantially square cross section enabling the operator to grip the shearing device 1 better and also enabling the operator to more accurately align the shears for cutting because the planar face 23 of the comb member 5 is perpendicular to the planar sides 61 and 63 of the square handle grip 59. A second safety feature of the present invention involves the relationship between the slot 29 and the first end portion 25 of the tensioning arm 11. Specifically, the first end portion 25 cannot be lifted out of the slot 29 without removing the comb member 5 or disassembling the shearing device 1. Cnsequently, if the cutter 21 and comb member 5 jam as when a foreign object is caught between them, the tensioning arm 11 will not slip out of the slot 29. On the contrary, the continual movement of the fork 9 will result in the cutter 21 or comb member 5 breaking rather than the tensioning arm 11 slipping out of the slot 29. Such slipping out which often occurs in present shears can have the disastrous consequences that the handpiece 3 immediately begins to rotate extremely rapidly within the operator's hand causing severe sprains as well as potentially more serious cutting wounds to the operator or sheep as the shears will essentially move uncontrollably until the power source is cut off. This safety feature is accomplished in the present invention by making the depth of the slot 29 a distance greater than the distance the first end portion 25 of the tensioning arm 11 can be moved from a position abutting the bottom of the slot 29 and applying maximum force to the fork 9 (representing the closest the first end portion 25 can be moved to the planar face 23 of the comb member 5) and a second position in which the first end portion 25 is farthest removed from the planar face 23 as defined by the limiting means 65. In this manner, the first end portion 25 cannot be removed from the slot 29 unless the comb member 5 is removed from the handpiece 3 or the shearing device 1 is otherwise dismantled.

While several embodiments of the present invention have been described in detail herein, it is understood that various changes and modifications can be made without departing from the scope of the invention.

I claim:

1. An animal shearing device comprising:

a hollow handpiece, a comb member having a substantially planar surface, means for rigidly mounting said comb member to said handpiece, a rigid, elongated arm having first and second ends, a cutter member, means for mounting said cutter member to said elongated arm adjacent said first end thereof, means for mounting said elongated arm substantially midway between said first and second ends and within said hollow handpiece for pivotal movement about first and second intersecting and perpendicular pivotal axes with said cutter member in sliding engagement with the planar face of said comb member whereby pivotal movement of said elongated arm about aid first pivotal axis reciprocally moves said cutter member along an arcuate path across the planar face of said comb member, said first pivotal axis being perpendicular to said planar face of said comb and said second axis being parallel to said planar face of said comb member, and, means for selectively adjusting the pressure with which the cutter member engages the planar face of said comb member, said adjusting means including a tensioning arm with first and second ends and means for mounting said tensioning arm for pivotal movement about an axis colinear with said first pivotal axis with said first end of said tensioning arm abutting said elongated arm at a predetermined, fixed location between said first pivotal axis and said first end of said elongated arm, said tensioning arm mounting means further including means for selectively, bodily moving said tensioning arm between at least first and second positions with said first end of said tensioning arm being closer to said planar face of said comb member in said first position than in said second position to selectively increase and decrease the pressure with which the cutter member engages the planar surface of said comb member and means for limiting the pivotal movement of said tensioning arm at said first and second positions to about said first pivotal axis.

2. The shearing device of claim 1 wherein said handpiece including a grip portion having a substantially square cross section with the ends of said square being respectively substantially perpendicular and parallel to said planar face of said comb member.

3. The sharing device of claim 1 wherein said predetermined, fixed location is substantially midway between said first pivotal axis and said first end of said elongated arm.

4. An animal shearing device comprising:

a hollow handpiece, a comb member having a substantially planar surface, means for rigidly mounting said comb member to said handpiece, an elongated arm having first and second ends, a cutter member, means for mounting said cutter member to said elongated arm adjacent said first end thereof, means for mounting said elongated arm within said hollow handpiece for pivotal movement about a first pivotal axis with said cutter member in sliding engagement with the planar face of said comb member whereby pivotal movement of said elongated arm about said first pivotal axis reciprocally moves said cutter member along an arcuate path across the planar face of said comb member, and, means for selectively adjusting the pressure with which the cutter member engages the planar face of said comb member, said adjusting means including a tensioning arm with first and second ends and means for mounting said tensioning arm for pivotal movement with said first end of said tensioning arm abutting said elongated arm at a location between said first pivotal axis and said first end of said elongated arm, said tensioning arm mounting means further including means for selectively moving said tensioning arm between at least first and second positions with said first end of said tensioning arm being closer to said planar face of said comb member in said first position than in said second position to selectively increase and decrease the pressure with which the cutter member engages the planar surface of said comb member and means for limiting the pivotal movement of said tensioning arm at said first and second positions to about a common pivotal axis fixed in relation to said first pivotal axis of said elongated arm, said elongated arm having a slot at said location between said first pivotal axis and said first end of said elongated arm for receiving said first end of said tensioning arm therein, said slot having a depth of a first distance in a direction perpendicular to said planar face of said comb member, said slot having a bottom, and said shearing device further including means for restricting the movement of said first end of said tensioning arm relative to said slot in a direction perpendicular to said planar face of said comb member rigidly mounted to said handpiece to a second distance representing the distance between the closest the first end of said tensioning arm can be moved toward said planar face while abutting the bottom of said slot and the farthest the first end can be moved away from said planar face, said second distance being less than said first distance whereby the first end of said tensioning arm cannot be lifted out of said slot while said comb member is rigidly mounted to said handpiece.

5. An animal shearing device comprising:

a hollow handpiece, a comb member having a substantially planar surface, means for rigidly mounting said comb member to said handpiece, a rigid, elongated arm having first and second ends, a cutter member, means for mounting said cutter member to said elongated arm adjacent said first end thereof, means for mounting said elongated arm substantially midway between said first and second ends and within said hollow handpiece for pivotal movement about first and second intersecting and perpendicular pivotal axes with said cutter member in sliding engagement with the planar face of said comb member whereby pivotal movement of said elongated arm about said first pivotal axis reciprocally moves said cutter member along an arcuate path across the planar face of said comb member, and, means for adjustably applying a force to said elongated arm symmetrically about and axially along an axis perpendicular to said planar face of said comb member at a predetermined, fixed location along said elongated arm between said first pivotal axis and said first end of said elongated arm.

6. The shearing device of claim 5 wherein said predetermined, fixed location is substantially midway between said first pivotal axis of said elongated arm and said first end of said elongated arm.

7. The shearing device of claim 5 wherein said means for selectively applying said force to said elongated arm includes a tensioning arm with first and second ends and means for mounting said tensioning arm for pivotal movement about an axis colinear with said first pivotal axis with said first end of said tensioning arm abutting said elongated arm at said predetermined, fixed location between said first pivotal axis and said first end of said elongated arm, said tensioning arm mounting means further including means for selectively, bodily moving said tensioning arm between at least first and second positions with said first end of said tensioning arm being closer to said planar face of said comb member in said first position than in said second position to selectively increase and decrease the pressure with which the cutter member engages the planar surface of said comb member and means for limiting the pivotal movement of said tensioning arm at said first and second positions to about said first pivotal axis.

* * * * *